US009702362B2

(12) United States Patent
Vogelsang et al.

(10) Patent No.: US 9,702,362 B2
(45) Date of Patent: Jul. 11, 2017

(54) ROTARY PISTON PUMP AND CASING HALF-SHELLS FOR SAME

(75) Inventors: Hugo Vogelsang, Essen (DE); Paul Krampe, Essen (DE)

(73) Assignee: Hugo Vogelsang Maschinenbau GmbH, Essen (DE)

( * ) Notice: Subject to any disclaimer, the term of this patent is extended or adjusted under 35 U.S.C. 154(b) by 357 days.

(21) Appl. No.: 13/885,400

(22) PCT Filed: Nov. 16, 2011

(86) PCT No.: PCT/EP2011/070229

§ 371 (c)(1),
(2), (4) Date: May 15, 2013

(87) PCT Pub. No.: WO2012/066026

PCT Pub. Date: May 24, 2012

(65) Prior Publication Data

US 2013/0236348 A1 Sep. 12, 2013

(30) Foreign Application Priority Data

Nov. 16, 2010 (DE) ..... 20 2010 015 439 U

(51) Int. Cl.
*F03C 2/00* (2006.01)
*F04C 18/12* (2006.01)
(Continued)

(52) U.S. Cl.
CPC ..... *F04C 18/12* (2013.01); *F04C 2/086* (2013.01); *F04C 2/126* (2013.01); *F04C 2250/30* (2013.01)

(58) Field of Classification Search
CPC ..... B29B 7/486; B29B 13/04; F04D 29/58; F04C 2240/10; F04C 2250/30; F04C 2230/602; F04C 2230/70
(Continued)

(56) References Cited

U.S. PATENT DOCUMENTS 1,590,964 A * 6/1926 Street ..... F04C 2/086 418/178
3,011,445 A * 12/1961 Bourke ..... F04C 2/1075 417/440
(Continued)

FOREIGN PATENT DOCUMENTS

DE 102005017575 A1 3/2006
DE 102007054544 A1 6/2008
(Continued)

OTHER PUBLICATIONS

Chinese Patent Application No. 201180055090.9 Office Action dated Feb. 2, 2015 and English translation.
(Continued)

*Primary Examiner* — Mark Laurenzi
*Assistant Examiner* — Anthony Ayala Delgado
(74) *Attorney, Agent, or Firm* — Kilpatrick Townsend & Stockton LLP; Dean W. Russell; Eben D. Allen

(57) ABSTRACT

The invention relates to a rotary lobe pump for conveying a fluid medium containing solids, comprising an inlet and an outlet for the medium being conveyed, and further comprising a pump casing and two rotary lobes arranged in said pump casing and having intermeshing rotary lobe vanes. According to the invention, the pump casing has two opposite casing half-shells which seal the pump casing fluid-tightly. The casing half-shells are double-walled.

17 Claims, 4 Drawing Sheets

(51) Int. Cl.
*F04C 2/08* (2006.01)
*F04C 2/12* (2006.01)

(58) Field of Classification Search
USPC ..... 418/191, 206.3, 206.5, 205
See application file for complete search history.

(56) References Cited

U.S. PATENT DOCUMENTS

| | | | | | |
|---|---|---|---|---|---|
| 3,265,292 | A * | 8/1966 | Schibbye | F02B 53/00 | 418/202 |
| 4,995,796 | A * | 2/1991 | Kambe | F04C 18/126 | 418/15 |
| 5,318,416 | A * | 6/1994 | Hantschk | F01C 21/10 | 102/481 |
| 6,126,425 | A * | 10/2000 | Fukui | F04C 29/04 | 418/201.1 |
| 6,572,351 | B2 * | 6/2003 | Durand | F01C 21/104 | 418/149 |
| 2009/0110579 | A1 * | 4/2009 | Amburgey | F04C 2/1075 | 418/48 |
| 2010/0226808 | A1 * | 9/2010 | Schofield | F04C 18/126 | 418/206.6 |

FOREIGN PATENT DOCUMENTS

| | | | | |
|---|---|---|---|---|
| DE | 102011000732 | B3 * | 8/2012 | F04C 2/126 |
| EP | 0225937 | A1 | 6/1987 | |
| EP | 0283755 | A1 | 9/1988 | |
| EP | 0738833 | A1 | 10/1996 | |
| EP | 1624189 | | 2/2006 | |
| GB | 1434566 | A | 5/1976 | |
| WO | 2006015766 | A1 | 2/2006 | |
| WO | 2007026109 | A1 | 3/2007 | |

OTHER PUBLICATIONS

International Search Report dated May 6, 2013 in Application No. PCT/EP2011/070229.

Written Opinion of the International Searching Authority and International Search Report for PCT/EP2011/070229, mailed Jun. 5, 2013 (7 pages for the original document and 8 pages for the English translation).

International Preliminary Report on Patentability for PCT/EP2011/070229, mailed Jul. 10, 2013 (5 pages for the original document and 7 pages for the English translation).

Chinese Patent Application No. 201180055090.9, Office Action dated Oct. 9, 2015.

* cited by examiner

ROTARY PISTON PUMP AND CASING HALF-SHELLS FOR SAME

CROSS REFERENCE TO RELATED APPLICATIONS

This application is the U.S. national phase of International Application No. PCT/EP2011/070229 filed on Nov. 16, 2011, which application claims priority to German Patent Application No. 202010015439.1 filed on Nov. 16, 2010, the contents of both of which are incorporated herein by reference.

The invention relates to a rotary lobe pump for conveying a fluid medium containing solids, comprising an inlet and an outlet for the medium being conveyed, and further comprising a pump casing and two rotary lobes arranged in said pump casing and having intermeshing rotary lobe vanes. The two shafts may preferably be coupled to each other by a gear transmission disposed in a gearbox casing.

The invention further relates to a casing for a rotary lobe pump for conveying a fluid medium containing solids.

Rotary lobe pumps of the kind specified above are used not only to convey all kinds of fluids, but also and in particular to convey sludge, wastewater, black water, brackish water, thick matter, bilge water, faecal matter, liquid manure, chemicals and feedstuffs. Rotary lobe pumps of the kind initially specified are known from the applicant's patents DE 10 2007 054 544 A1 and EP 1 624 189 B1, for example, and from DE 10 2005 017 575 A1 and WO 2007/026 109 A1, and are used to convey a fluid medium containing solids.

Via an inlet opening arranged on the pump casing, the medium to be conveyed enters the interior of the pump casing, where it is conveyed by the intermeshing rotary lobe vanes of two driven rotary lobes in the direction of an outlet opening arranged on the pump casing, and leaves the interior of the pump casing again through the outlet opening. Each of the two rotary lobes is generally fixed torque-resistantly on a respective shaft and can be driven by said respective shaft, the two shafts being coupled to each other by a transmission gear arranged in a gearbox casing.

Prior art rotary lobe pumps are self-priming and resistant to dry running. The functional principle is based on the rotary lobe pump, which operates as a displacement pump, transporting the fluid by means of the two rotary lobes along a wall of the casing from the pump inlet to the pump outlet, while the two intermeshed rotary lobes in the middle of the casing contact each other fluid-tightly and rotate in opposite directions.

The invention is based on the realisation that the casings of prior art rotary lobe pumps are either produced as block construction pumps and consist of a solid casing block, or are composed of a plurality of casing shells.

The invention is based on the discovery that pump casings produced from solid blocks are very complex to make because the complicated inner geometry of the pump chamber must generally be produced using metal removal techniques and with a high level of surface quality. Another disadvantage of solid block casings for rotary lobe pumps is that they are very heavy and have to be replaced in their entirety even when only part of the housing has worn down. The only remedy for such rotary lobe pumps with these types of casing is to provide additional shell-shaped inserts that wear faster and can be replaced when necessary.

The advantage of rotary lobe pumps based on the invention, in contrast, which have a pump casing comprising casing shells, is that the only parts of the pump casing which need to be replaced are those which require maintenance and replacement, whereas other casing parts subjected to less wear do not need to be replaced. Pump casings of this kind are sealed fluid-tightly by clamping means, by clamping the casing half-shells against each other or against other casing parts. In addition, the boundary surfaces of the casing half-shells are sealed to prevent fluid from entering and/or escaping, for example by means of paper seals.

Another discovery of the present invention is that pump casings having two casing half-shells allow the further theoretical advantage, with regard to production engineering, that they can be manufactured by producing a round casing and subsequently severing such a casing into two casing half-shells. Although this simplifies the machining of the inner surface of the casing half-shells, in that a circular inner surface can then be processed, it has been found that, after severing the machined component into two housing half-shells, the desired accuracy and geometric precision of the casing half-shells is not achieved due to internal stresses. This necessitates complex post-processing or appropriate tensioning of the casing halves during assembly. The theoretical advantage from the production engineering perspective is offset by a further disadvantage in such a case, with the result that split casings are also disadvantageous in the case of rotary lobe pumps.

The object of the present invention is therefore to specify a rotary lobe pump having an improved pump casing which overcomes these disadvantages in respect of production and also precision.

Another object of the invention was to specify an improved casing for a rotary lobe pump.

The invention achieves its object with a rotary lobe pump of the kind initially specified, in that the pump casing has two casing half-shells opposite one another which seal the pump casing fluid-tightly, and in that the casing half-shells are double-walled. The invention makes use of the discovery that the stability of the casing as a whole and of the casing half-shells themselves is significantly enhanced by the casing being designed with double walls, without having to abandon the modular construction concept using half-shells. The double-walled design of the casing half-shells gives rise to a number of surprising advantages. The whole pump casing is less susceptible to vibration. The stability of the rotary lobe pump under pressure and under the influence of external forces, for example of forces exerted as a result of pipe tension, is increased. Due to the enhanced stability deriving from the double-walled design, the dimensional accuracy of the casing half-shells is increased, which is advantageously reflected in improved manufacturing precision. As a result of improved manufacturing precision, it is possible for the pump casing to be assembled without the need of paper seals or similar seals. The casing half-shells can preferably be clamped directly to each other without sealants, or can be brought into contact with one or more other casing parts and clamped together fluid-tightly. As an option, the pump casing has a film-like sealant between the casing parts. The manufacturing tolerances of the assembled pump casing are further improved, in any case, due to the avoidance of paper seals or similar kinds of seals such as those which are still required by prior art rotary lobe pumps.

When reference is made to the casing half-shells being opposite each other, this should be understood to mean that the casing half-shells are opposite each other in the sense of mirror symmetry or line symmetry, in relation to a plane through which the longitudinal axis of the rotary lobe pump runs and which is perpendicular, in particular, to a plane which encompasses the rotational axes of the rotary lobes.

The rotary lobe pump according to the invention permits an advantageous form of production, in that the casing half-shells are firstly cast as a contiguous casing with a circular cross-section, and that its inner surface is machined to completion in a continuous cut, for example on a lathe. This double-walled casing is then cut into two casing half-shells, thus avoiding, due to the greater stiffness of the casing, the familiar problems resulting from warping and internal stresses. The geometry of the pump chamber is then achieved by attaching the two casing halves to either side of an axial intermediate casing, for example.

The invention is advantageously developed by a cavity being formed between an inner wall of the casing half-shell and an outer wall of the casing half-shell. The inner wall is at a distance from the outer wall. This results in vibrations being transmitted to the outer wall to a much lesser extent. Torsional rigidity is increased. The cavity can also be filled, preferably with an acoustic damping material.

One or more struts extending from the inner wall to the outer wall is/are preferably formed in the cavity of the casing half-shell. By means of such struts, the stiffness of the casing half-shells and hence of the pump casing and ultimately of the entire rotary lobe pump is further increased. The struts are preferably adapted to brace the inner wall against the outer wall.

According to another preferred embodiment of the invention, one or more ribs extending from the inner wall to the outer wall are formed in the cavity of the casing half-shell. The stiffness of the casing half-shells and hence of the pump casing and ultimately of the entire rotary lobe pump is likewise further increased by means of such ribs. The ribs are preferably adapted to support the inner wall against the outer wall. In one preferred development of the invention, ribs as well as webs are provided for mutual support between the inner wall and the outer wall.

In yet another advantageous development of the invention, the outer wall of the casing half-shell has a through hole which is formed to receive or dispense a coolant into or out of the cavity between the inner wall and the outer wall. As an alternative, a heated fluid may also be supplied and/or discharged in order to maintain a favourable temperature for the respective pump operation inside the pump casing. A cooling system containing means for regulating the temperature of the cooling or heating fluid can preferably be connected or is connected communicatingly to the rotary lobe pump or to one or both casing half-shells. In one preferred embodiment, each casing half-shell has ribs and/or webs between the inner wall and the outer wall and has an inner space through which cooling or heating fluid flow, such that the webs and/or ribs are designed to guide the fluid inside the cavity. In this way, cooling or heating fluid can be made to flow preferentially around specific areas.

The rotary lobe pump according to the invention preferably has an intermediate casing. The casing half-shells are preferably connected fluid-tightly to each other by means of the intermediate casing. In this embodiment, the pump casing preferably comprises two casing half-shells and the intermediate casing connecting the two casing half-shells. It is preferred that the intermediate casing and the casing half-shells each have matchingly adapted end faces which can be brought fluid-tightly into contact with the end faces of the respectively adjacent casing.

The intermediate casing preferably defines a distance between the two casing half-shells, and the distance between the two casing half-shells can be adjusted according to the level of wear. A plurality of differently positioned fit bores are provided, which can be brought into engagement in different configurations with close-fitting elements, in particular with slotted straight pins or fitting screws, wherein the close-fitting elements are respectively configured to position the housing half-shells at different respective distances relative to the intermediate casing compared to other configurations. Said position can be subsequently adjusted in this way according to the level of wear of the casing half-shells. The casing half-shells preferably have an inner surface which cooperates substantially fluid-tightly with the rotary lobes which are disposed relative to said inner surface and rotatably relative to said inner surface, in order to form one or more conveying cavities. The inner surface is exposed to wear, in particular when the fluid conveyed by the rotary lobe pump is laden with solids, and it wears away in the course of time when the pump is in continuous operation. As a result of the adjustability provided by the invention, the length of time required until a casing half-shell needs to be replaced is thus extended.

The intermediate casing preferably has replaceable spacer elements. The spacer elements are preferably embodied as shims or flat members which can be disposed between the intermediate casing and the casing half-shells in order to define the distance between the adjacent casing half-shells and/or between a respective casing half-shell and the intermediate casing. The spacer elements are preferably manufactured with a narrow tolerance range, such that the aforementioned distance can be set within a range of less of 1 mm, and particularly preferably within a range of less than 0.3 mm.

In a preferred embodiment of the rotary lobe pump, the intermediate casing is double-walled. The intermediate casing preferably has an inner wall and an outer wall, with a cavity being formed between the inner wall and the outer wall of the intermediate casing. A particularly preferred embodiment is one in which the cavities of the casing half-shells and of the intermediate casing are communicatingly connected to each other. The advantages provided by the cavity formed in the casing half-shells are also claimed by the intermediate casing provided with such a cavity. In particular, the intermediate casing is thus embodied such that it can be filled with a means for acoustic damping and/or with a coolant and/or heating fluid which can flow around the intermediate casing.

According to one preferred embodiment, the opposite casing half-shells and the intermediate casing have axial end faces which are connected, in particular clamped together, by means of threaded rods, said threaded rods preferably being arranged on the inner side in a cavity in the casing half-shells and/or in the intermediate casing, as described in the foregoing. Arranging the threaded rods or equivalent tensioning means on the inner side provides several advantages. Firstly, the threaded rods are better protected against corrosion and mechanical effects, and their production and maintenance are made easier with regard to coating and cleaning. The inner arrangement also allows the intermediate casing and/or the respective casing half-shell to be provided with a symmetrical end face. The threaded rods can preferably be arranged inside the cavity of the casing half-shells and/or of the intermediate casing in such a way that a clamping force applied by means of the threaded rods is transmitted substantially uniformly onto the inner wall and the outer wall. The preferable result is that no bending moment ensues.

It is still further preferred that the two opposite casing half-shells form a first pair of casing half-shells and that there is at least one second, other pair of two oppositely arranged casing half-shells which are arranged axially adjacent to the first pair of casing half-shells such that one casing half-shell of the first pair has an axial end face and said axial end face is connected to an axial front face of a casing half-shell of the second pair and the respective other casing half-shell of the first pair has an axial end face, and said axial end face is connected to an axial front face of the respective other casing half-shell of the second pair. This configuration allows a model series of rotary lobe pumps to be manufactured efficiently and at a high level of quality, in that the pump volume is increased by axially arranging a plurality of casing half-shell pairs accordingly. The warpage accuracy and manufacturing precision of the double-walled casing half-shells allows two or more casing half-shells to be axially arranged immediately adjacent one another, thus allowing a rotary lobe pump to be produced which has an enhanced pump volume (e.g. by a factor of 1.5 or 2 or 3) compared to rotary lobe pumps comprising only one pair of casing half-shells.

According to another preferred embodiment of the invention, spacer elements for axially extending the intermediate casing and/or spacer elements for axially extending the casing half-shells are provided. These spacer elements preferably match the axial cross-section of the casing half-shells and the intermediate casing. They have a defined thickness and extend the casing half-shells and the intermediate casing in the axial direction by applying the principle of shims, in order to compensate for manufacturing tolerances or to meet application-specific requirements, and to allow the use of casing half-shells or intermediate casings produced in standardised form. The spacer elements may be used in the assembly and adjustment of rotary lobe pumps comprising one pair of casing half-shells in the same way as in rotary lobe pumps comprising two or more pairs of casing half-shells.

In a casing half-shell of the kind initially specified, for a rotary lobe pump for conveying a fluid medium containing solids, the invention achieves its object by embodying the casing half-shell with double walls.

Other advantageous variants of the casing half-shell are derived from the above description of the preferred embodiments of the rotary lobe pump according to the invention. Reference is made to said description.

The invention also relates to a method for producing casing half-shells for a rotary lobe pump for conveying a fluid containing solids.

A casing half-shell according to the invention, for a respective rotary lobe pump, must meet tough requirements with regard to the cylindricity of its inner surface, given that said inner surface is part of the conveying cavities of a rotary lobe pump.

Prior art methods for producing such casing half-shells involve two casing half-shells being cast in moulds and subsequently mounted to each other. After such assembly, half a cylindrical inner surface is formed in the respective casing half-shells by skimming. Exact positioning and subsequent repositioning of the casing half-shells in relation to each other are a production engineering challenge for the manufacturer and consume a substantial amount of time and effort.

The object of the invention was therefore to specify an improved method for producing a improved casing half-shell according to the invention, in order to obtain an improved rotary lobe pump.

The invention achieves this object with a method of the aforementioned kind, comprising the steps of:

providing or producing a casing mould for a casing blank, the casting mould being formed as a negative of a casing blank and adapted to produce the casing blank integrally in such a way that said casing blank has two half-shell sections and is double-walled, producing the casing blank by introducing free-flowing material casting material into the casting mould and hardening the free-flowing casting material, processing the casing blank so that a cylindrical inner surface of the casing blank results, and separating the half-shell sections of the casing blank, following the step of processing the casing blank, so that two casing half-shells result, each being double-walled.

The method according to the invention utilises the realisation that the cylindricity of the inner surface of a respective casing half-shell can be achieved most reliably when the inner surface is provided in an integral casing slug or blank. However, prior art methods do not permit this because of tensions which ensue in the casing blank due to joining and shaping factors in prior art casting methods using prior art casting moulds, which resulted in turn in an unreliably high level of dimensional warping when separation into two half-shells was not carried out until after casting and processing the casing blank, for example by skimming the inner surface. The casing blank sprang open, to a certain extent. The method according to the invention addresses this problem by providing a casting mould for a casing blank, which is formed as a negative of a casing blank and adapted to produce the casing blank integrally in such a way that said casing blank has two half-shell sections and is double-walled. Embodying the half-shell sections with double walls by means of the correspondingly designed casting mould drastically reduces dimensional warping when the half-shell sections are subsequently separated. This therefore allows the casing blank, which is still integral, to be processed in such a way that a cylindrical inner surface of the casing blank results, and that the half-shell sections of the casing blank are not separated until this step has been completed. By means of the method according to the invention, casing half-shells of high dimensional stability are obtained with significantly reduced production cost and effort compared to prior art methods. A casing half-shell produced by the inventive method also has a number of advantages, as already described in the foregoing and to which reference is hereby made.

The method is further developed by forming a cavity between an inner wall of the casing blank and an outer wall of the casing blank. It is particularly preferred that the cavity be formed by means of the casting mould. Alternatively, the cavity is formed by removal of material after the casing blank has been hardened.

In another preferred variant of the method, the casing blank is produced in such a way that one or more struts and/or ribs extending from the inner wall to the outer wall are formed in the cavity of the casing blank. It is particularly preferred that the webs and/or ribs are formed by means of the casting mould. Alternatively, the ribs and/or webs are introduced into the cavity after the casing blank has been hardened, for example by bolting, dowelling, riveting, welding, soldering or glueing.

The half-shell sections of the casing blank are preferably separated by cutting, for example by sawing. A cut edge of high quality is achieved by sawing and by post-processing the cut edge, if necessary, for example by milling.

Alternatively, the half-shell sections of the casing blank are separated without removal of material, for example by waterjet cutting or laser cutting. Waterjet cutting is advantageous, in that the thermal impact on the cutting zone is minimal.

Processing of the casing blank so that a cylindrical inner surface of the casing blank results is preferably carried out using a cutting technique, for example by turning on a lathe.

In one preferred variant, the method according to the invention also comprises the steps of:

thermal aftertreatment of the casing blank following hardening of the free-flowing casting material, so that internal stress in the casing blank is reduced. This further improves the dimensional accuracy of the casing half-shells.

The invention shall now be described in greater detail with reference to preferred embodiments and to the attached Figures, in which FIG. 1 shows a schematic cross-sectional view of a pump casing of a rotary lobe pump;

FIG. 1*a* shows another cross-sectional view of the pump casing of FIG. 1, shown with an intermediate casing.

Figure 1:
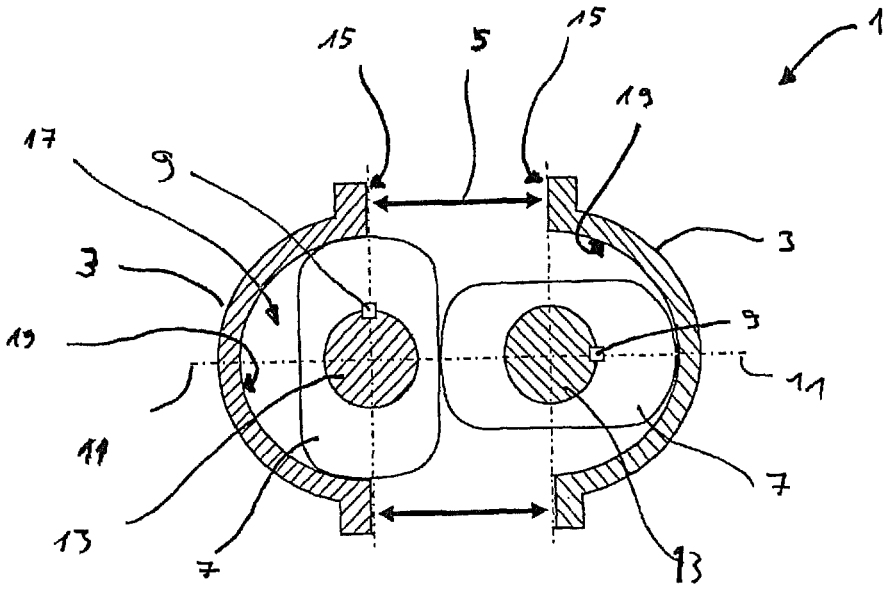

FIG. 1 shows the basic structure of pump casing 1 of a rotary lobe pump according to the present invention. Pump casing 1 has two casing half-shells 3. The casing half-shells 3 are arranged at a distance 5 from each other. Distance 5 preferably corresponds to the distance between two drive axles 13. Drive axles 13 are associated with a gear transmission (not shown), are arranged parallel in a plane 11 and are each connected torque-resistantly by means of a tongue 9 to a rotary lobe 7.

Figure 1A:
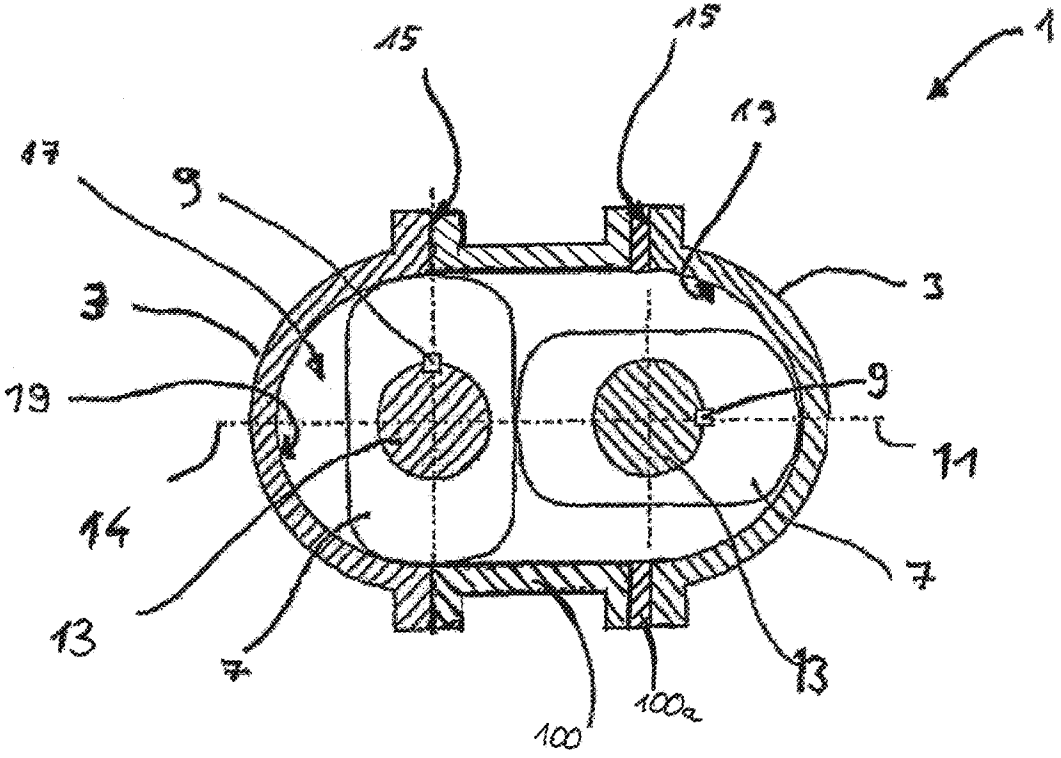

The casing half-shells 3 have side surfaces 15 which face each other. Side surfaces 15 are designed to be joined fluid-tightly to an intermediate casing 100 (see FIG. 1*a*). The intermediate casing defines the distance 5 to be preferably set between the casing half-shells 3. As shown in FIG. 1*a*, a spacer element 100*a* is disposed between the intermediate casing 100 and the casing half-shells 3.

The casing half-shells each have an inner surface 19. Each inner surface 19 preferably has a semi-cylindrical contour. In the position shown, rotary lobe 7 on the left in FIG. 1 forms a conveying cavity 17 between itself and inner surface 19 of associated casing half-shell 3.

The double-walled structure of casing half-shell 3 is shown in more detail in the following Figures.

Figure 2:
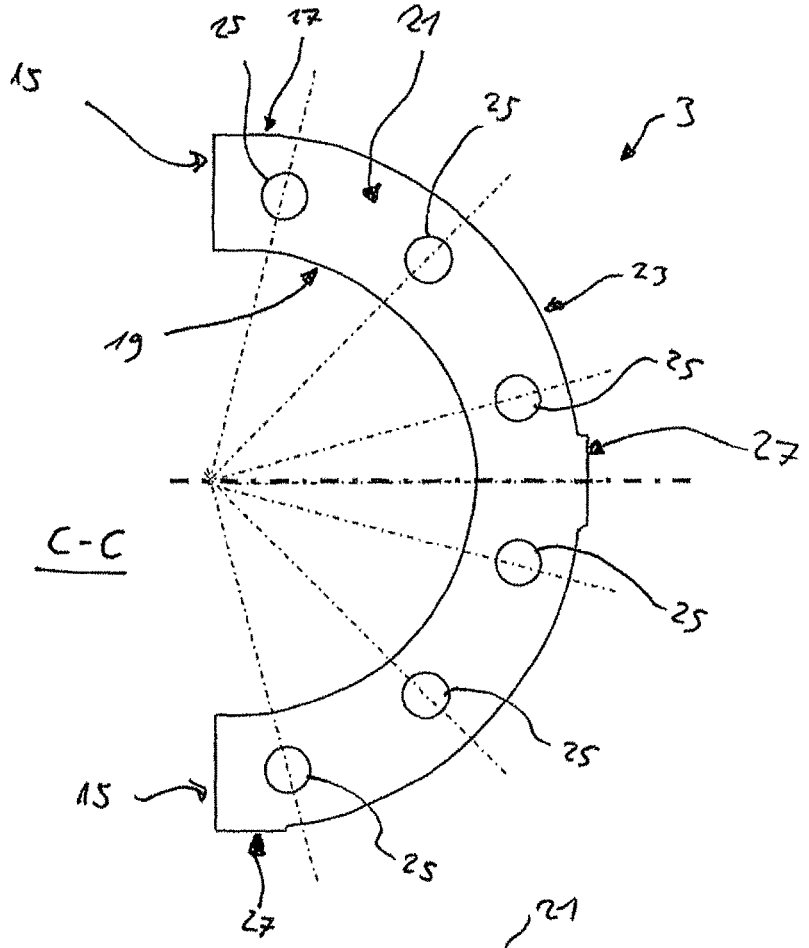
FIG. 2 shows a side view of a casing half-shell according to the present invention.
Figure 3:
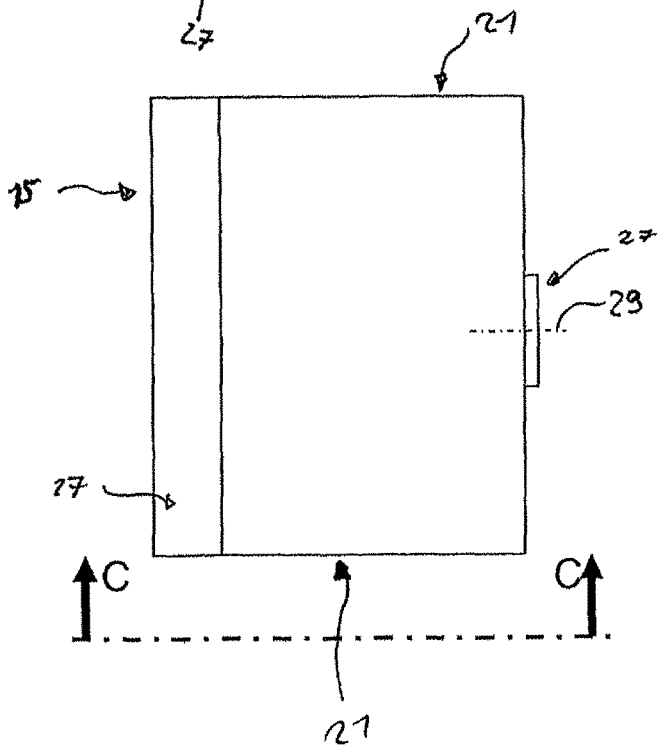
FIG. 3 shows another side view of the housing half-shell in FIG. 2.

FIGS. 2 and 3 each show a projection of a side view of a casing half-shell 3 according to the present invention. Casing half-shell 3 has an end face 21. End face 21 is preferably planar and can be brought into contact with a matching surface of a cover (not shown). Between an outer surface 23 and inner surface 19, casing half-shell 3 has a number of through holes 25 in end face 21, which extend from end face 21 into a cavity (see FIG. 4). Through holes 25 are distributed evenly along end face 21. The substantially cylindrical outer surface 23 has a number of planar surface sections 27 along its length. Surface sections 27 are adapted to receive radial through holes 29, fit bores or the like.

Figure 4:
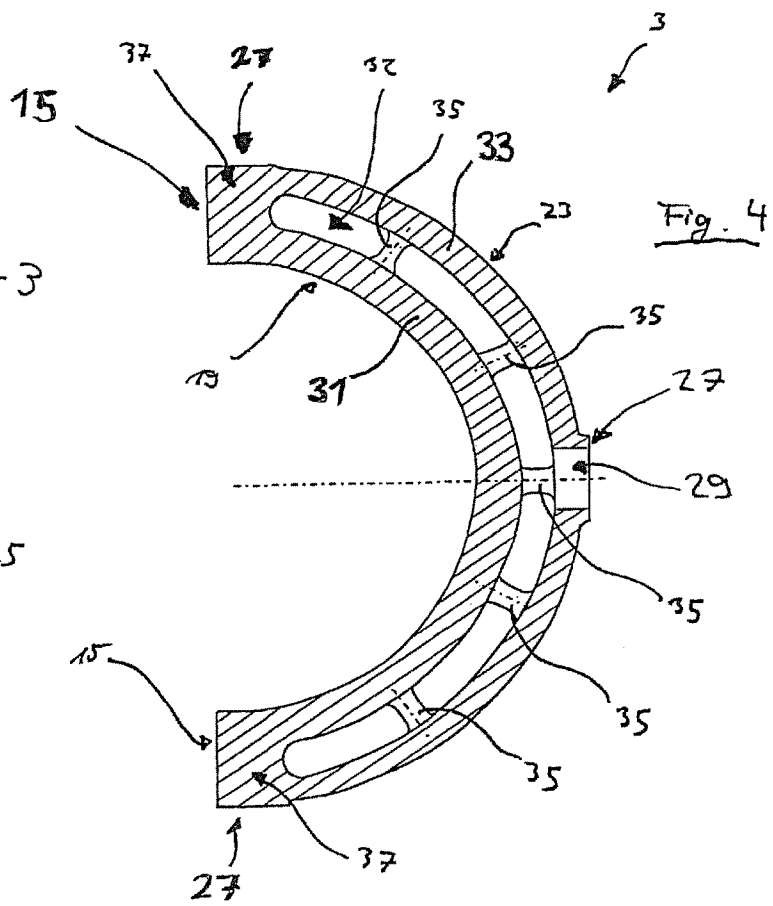
FIG. 4 shows a cross-sectional view of the casing half-shell in FIGS. 2 and 3.
Figure 5:
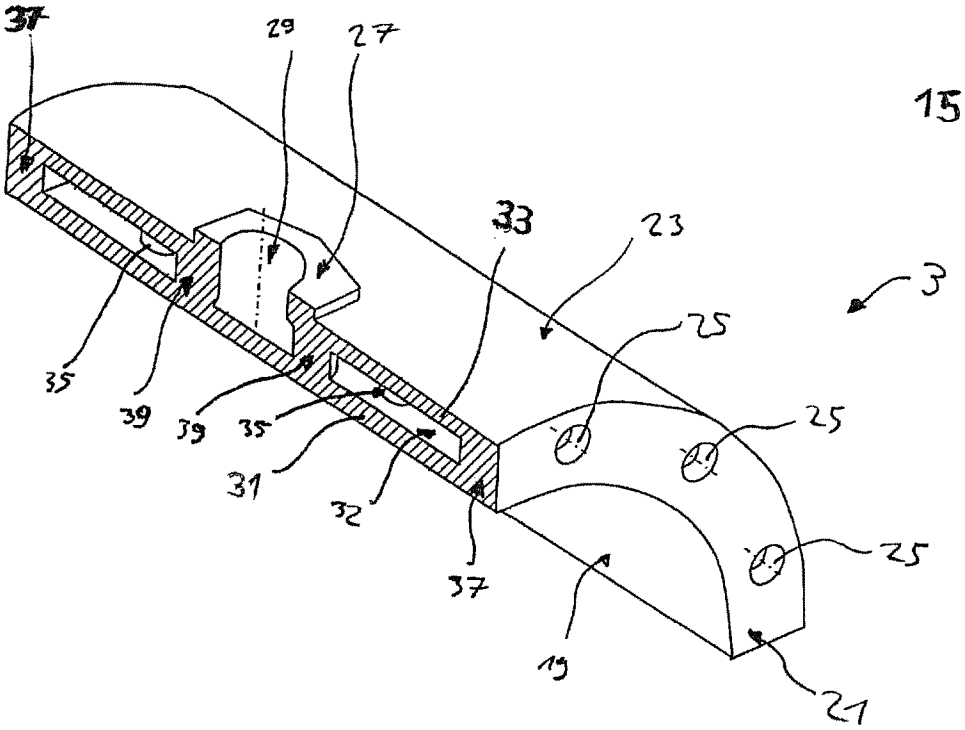
FIG. 5 shows a spatial cross-sectional view of the casing half-shell in FIGS. 2 to 4.

FIGS. 4 and 5 each show cross-sectional views of a casing half-shell according to the present invention. FIG. 4 shows a cross-sectional view through a casing half-shell according to one preferred embodiment of the present invention, whereas FIG. 5 shows a spatial view of a quarter section of the casing half-shell according to the invention. Reference is made, with regard to identical reference signs, to the above description of FIGS. 1 to 3. As shown in FIG. 4, casing half-shell 3 has an inner wall 31 and an outer wall 33. A cavity 32 is formed between inner wall 31 and the outer wall. The casing half-shells are double-walled. A number of webs 35 are formed between inner wall 31 and outer wall 33. Webs 35 each extend between inner wall 31 and outer wall 33. Webs 35 are adapted to support inner wall 31 and outer wall 33 against each other. Through hole 29 shown here extends from one of the planar sections 27 of outer surface 23 through the outer wall 33 into cavity 32. Through hole 29 is selectively formed as an inlet or an outlet and is designed to receive and/or discharge a coolant and/or heating medium and/or is designed to receive a filling material such as a vibration-absorbing or sound-absorbing material, with which cavity 32 can be filled. Sensors, or data lines or power lines, can also be optionally laid in cavity 32 by means of through hole 29. A casing half-shell 3 preferably has a plurality of through holes 29.

Outer wall 33 and inner wall 31 are connected to each other in a lateral section 37 and preferably merge integrally with each other.

Side surfaces 15 are parallel to each other. The inner surface 19 extending on the inside between side surfaces 15 is semi-cylindrical and spans an angle of 180°.

FIG. 5 shows that a reinforcement 39 is formed in cavity 32 in the region of through hole 29. Reinforcement 39 provides further support for inner wall 31 against outer wall 33 in the region of through hole 29.

The invention claimed is:

1. A rotary lobe pump for conveying a fluid medium containing solids, the rotary lobe pump comprising an inlet and an outlet for the medium being conveyed, and further comprising a pump casing, a first rotary lobe rotatable about a first axis of rotation, and a second rotary lobe rotatable about a second axis of rotation, wherein said first and said second rotary lobes are arranged in said pump casing and have intermeshing rotary lobe vanes, wherein the pump casing comprises:

a first casing half-shell having a double-walled first body, the double-walled first body comprising:

a first outer wall having a first half-cylindrical shape that curves between and terminates adjacent to first side surfaces of the first casing half-shell; and a first inner wall which is arranged at a uniform first radius from said first axis of rotation and which spans an angle of 180° about said first axis of rotation;

a second casing half-shell having a double-walled second body, the double-walled second body comprising:

a second outer wall having a second half-cylindrical shape that curves between and terminates adjacent to second side surfaces of the second casing half-shell; and a second inner wall which is arranged at a uniform second radius from said second axis of rotation and which spans an angle of 180° about said second axis of rotation, wherein said uniform second radius is equal to said uniform first radius;

wherein the first casing half-shell and the second casing half shell are arranged opposite one another so that the first side surfaces of the first casing half-shell and the second side surfaces of the second casing half shell face one another and are separated from each other by a distance; and an intermediate casing that extends across the distance, wherein the first casing half-shell and the second casing half-shell are connected fluid-tightly to each other by at least the intermediate casing to seal the pump casing fluid-tightly and define boundaries of an oblong chamber in which the first rotary lobes and the second rotary lobe are located.

2. The rotary lobe pump according to claim 1, wherein a cavity is formed between an inner wall of one of the two casing half-shells and the outer wall of the one of the two casing half-shells.

3. The rotary lobe pump according to claim 2, wherein one or more struts extending from the inner wall to the outer wall are formed in the cavity of the one of the two casing half-shells.

4. The rotary lobe pump according to claim 2, wherein one or more ribs extending from the inner wall to the outer wall are formed in the cavity of the one of the two casing half-shells.

5. The rotary lobe pump according to claim 2, wherein the outer wall of the one of the two casing half-shells has a through hole which is formed to receive or dispense a coolant into or out of the cavity between the inner wall and the outer wall.

6. The rotary lobe pump according to claim 1, wherein the distance between said two casing half-shells can be adjusted according to the level of wear.

7. The rotary lobe pump according to claim 1, wherein the intermediate casing has an inner wall and an outer wall, and a cavity is formed between the inner wall and the outer wall of the intermediate casing.

8. The rotary lobe pump according to claim 1, wherein the opposite casing half-shells and the intermediate casing have axial end faces which are connected and clamped by threaded rods, said threaded rods being arranged on an inner side in a cavity.

9. The rotary lobe pump according to claim 1, wherein the first and second casing half-shells form a first pair of casing half-shells and further comprising at least one second, other pair of two oppositely arranged casing half-shells, which are arranged axially adjacent to the first pair of casing half-shells such that:

the first casing half-shell of the first pair has an axial end face and said axial end face is connected to an axial end face of a casing half-shell of the second, other pair; and the second casing half-shell of the first pair has an axial end face, and said axial end face is connected to an axial end face of a second casing half-shell of the second, other pair.

10. The rotary lobe pump according to claim 1, further comprising replaceable spacer elements for axially extending the intermediate casing and/or comprising replaceable spacer elements for axially extending the casing half-shell.

11. A method for producing the rotary lobe pump of claim 1, wherein the first and second casing half-shells are formed by steps comprising:

providing or producing a casting mould for a casing blank, the casting mould being formed as a negative of a casing blank and adapted to produce the casing blank integrally in such a way that said casing blank has two half-shell sections and is double-walled, producing the casing blank by introducing free-flowing material casting material into the casting mould and hardening the free-flowing casting material, processing the casing blank so that a cylindrical inner surface of the casing blank results, and separating the half-shell sections of the casing blank so that the first and second casing half-shells result, each being double-walled.

12. The method according to claim 11, wherein a cavity is formed between an inner wall of the casing blank and an outer wall of the casing blank.

13. The method according to claim 12, wherein the casing blank is produced in such a way that one or more struts extending from the inner wall to the outer wall are formed in the cavity of the casing blank.

14. The method according to claim 12, wherein the casing blank is produced in such a way that one or more ribs extending from the inner wall to the outer wall are formed in the cavity of the casing blank.

15. The method according to claim 11, wherein the half-shell sections of the casing blank are separated by removal of material or without removal of material.

16. The method according to claim 11, wherein processing of the casing blank so that a cylindrical inner surface of the casing blank results is performed using a cutting technique.

17. The method according claim 11, comprising the steps of:

thermal aftertreatment of the casing blank following hardening of the free-flowing casting material, so that internal stress in the casing blank is reduced.

* * * * *